US005809851A

United States Patent [19]

Thompson

[11] Patent Number: 5,809,851

[45] Date of Patent: Sep. 22, 1998

[54] THREADED FASTENER DRIVER

[75] Inventor: William J. Thompson, Fullerton, Calif.

[73] Assignee: Headfirst Products, Buena Park, Calif.

[21] Appl. No.: 867,717

[22] Filed: Jun. 5, 1997

[51] Int. Cl.[6] ..... B25B 13/02

[52] U.S. Cl. ..... 81/124.2; 81/901

[58] Field of Search ..... 81/124.2, 901, 81/119

[56] References Cited

U.S. PATENT DOCUMENTS

| | | | |
|---|---|---|---|
| 880,235 | 2/1908 | Neller . | |
| 898,912 | 9/1908 | Neller . | |
| 1,867,372 | 7/1932 | McGuckin | 81/124.2 |
| 2,106,712 | 2/1938 | Bertrand | 81/124.2 X |
| 3,086,414 | 4/1963 | Nardi | 81/176.1 |
| 4,275,621 | 6/1981 | Mallott | 81/124.2 X |
| 4,393,583 | 7/1983 | Zwald | 81/124.2 X |
| 4,413,660 | 11/1983 | Conrad . | |
| 4,689,881 | 9/1987 | Fall | 81/901 X |
| 4,724,731 | 2/1988 | Onofrio | 81/124.2 X |
| 4,749,251 | 6/1988 | Moulin | 81/124.2 X |
| 5,012,624 | 5/1991 | Dahlgren | 81/124.2 X |
| 5,040,573 | 8/1991 | Shepard . | |
| 5,439,338 | 8/1995 | Rosenberg | 81/124.2 X |
| 5,507,209 | 4/1996 | Allen et al. | 81/124.2 X |

OTHER PUBLICATIONS

"Instructions for LagMaster", Product Instruction Paper Prepared by Headfirst Products, Buena Park, CA, Feb. 11, 1997.

*Primary Examiner*—James G. Smith
*Attorney, Agent, or Firm*—Lawrence R. Franklin

[57] ABSTRACT

A driver for securing pre-wired threaded fasteners to the ceiling of a building structure includes a driver head, a pre-wired fastener held by the driver head, and a telescoping pole connected to the driver head. The driver head is a solid, cylindrical rod or shaft having a kerf opening through the top of the shaft and extending axially therefrom, the kerf extending either partially or completely across the diameter of the shaft. The kerf includes a tapered recess opening axially through one sidewall of the shaft. A blind recess shaped to receive the flat head of a threaded fastener also opens through the top of the shaft and intersects the kerf substantially orthogonally. The threaded fastener is pre-wired with a wire which has a closed loop at one end, the loop being off-set from the major lineal direction of the wire. When the head of the threaded fastener is fit into the blind recess, the wrap of the wire is loosely constrained against lateral motion by the tapered recess. A hollow telescoping pole has at least one aperture in a sidewall, the aperture positioned such that the free end of the wire can be inserted into the hollow interiior of the pole to confine the free end against spinning around the pole when the pole is rotated.

19 Claims, 3 Drawing Sheets

THREADED FASTENER DRIVER

BACKGROUND OF THE INVENTION

1. Field of The Invention

This invention relates to a method and apparatus for securing pre-wired threaded fasteners to a high ceiling by a special threaded fastener driver operated by a worker standing on the floor.

2. Description of Related Art

The history of the building art has shown activity in all phases relevant to the hanging of suspended ceilings from building structures.

Side-wrapping for forming loops on the ends of wires is known.

Neller, in U.S. Pat. Nos. 880,235 and 898,912, discloses two hand-operated, wire bending tools, the former for forming a loop in the end of the wire and the latter for twisting the free end around the wire to side-wrap the loop. No suggestion of any advantages derivable from side-wrapping is intimated. The fact that the wrap is a side-wrap appears to be a function of the structure of the ('912) tool which requires the wire be securely held while twisting the end therearound to form a loop. So far as the invention claimed herein, the disclosure by Heller of side-wrapped wire is an accidental anticipation and is not suggestive of the claimed invention.

Shepard, U.S. Pat. No. 5,040,573, discloses an automatic wire bending tool which forms a loop and wrap in a wire end. The structure of the tool and its mode of operation results in a side-wrapped wire, but, again, the side-wrapping appears to be accidental, dependent upon the structure of the wire bending machine necessary to simultaneously hold and twist the wire, and has no specific function intended therefor. Also taught is the pre-wiring of the side-wrapped wire on a suspension bracket for suspended ceilings. No suggestion of the invention claimed herein pertaining to the disclosed advantages of side-wrapping or of pre-wiring a threaded fastener is present in the reference.

Drivers for threaded fasteners are also known in the art.

U.S. Pat. No. 4,724,731, to Onofrio discloses a two-piece lag screw driver combining a body member having a bifurcated end slotted to receive the flat end of a lag screw and internally shaped to grip the body of the lag screw and a sleeve which slips over the bifurcated end to strengthen it. The drive end of the driver body member is shaped to fit a drill, screwgun, or other power source. The lag driver of Onofrio is acceptable for driving lag screws which are not pre-wired, but it lacks provisions for handling a wire already attached to a threaded fastener. Also, requiring two pieces, it is slow and cumbersome to use in the field.

U.S. Pat. No. 5,012,624, to Dahlgren shows a tool for screwing threaded ceiling fasteners into a ceiling, the tool having a hollow driver head including a hollow upper portion with cross-slots forming four cantilevered columns adapted to receive the flat head of a fastener to rotate it. The driver head also includes a hollow cylindrical lower portion threadedly connected to the upper portion, the lower portion having a pair of opposed apertures. In use, a wire is inserted through one of said opposed apertures, upwardly through both the upper and lower portions, through a hole in the head of the lag screw, back through both the upper and lower portions, and through the other of said opposed apertures. The flat head of the lag screw is placed in one of the cross-slots, and the wires are pulled taut. A collar is mounted on the free ends of the columns to confine the wire ends to the cross-slots. A motor, drill, or other rotating means rotates the tool, screwing the fastener into the ceiling. After removing the fastener from the driver head, the tool is again rotated to twist the wires together. Obviously, the tool is very complex and the method of using it is labor intensive, which severely limits the practicality of using the tool in the field.

U.S. Pat. No. 5,439,338 to Rosenberg shows a driver head for screwing anchor bolts into walls. The driver head comprises a socket having a cruciform recess therein for receiving the flat eye-bolt head of a bolt and a conical recess for receiving a cone attached to the bolt. The cylindrical walls and base of the socket are imperforate. A power drill is mounted to a pin on the driver head to rotate it. Pre-wired threaded fasteners cannot be used with this driver head, for there is nothing provided to control the free end of the wires.

U.S. Pat. No. 5,507,209 to Allen et al. discloses a driver comprising four distinct parts: (1) a hollow sleeve made of a suitable material such as plastic or PVC piping; (2) a screw holder fixed within said sleeve, said screw holder having crossed slots for receiving the flat eye-bolt head of a screw; (3) a screw stabilizer made of hard rubber, the stabilizer being secured to the sleeve either by a tether or by set screws; and (4) an extendable pole, utility rod, or tree trimmer attached to the base of the sleeve. The device is intended to suspend food or other supplies from a tree when camping, hiking, or hunting. To such an end, a slot formed through the sidewall of the sleeve permits a rope, tackle, or other apparatus to be attached to eye-bolt head 70 such that it remains with eye-bolt head 70 after the screw has been removed from the crossed slots. The stabilizer has a release slit connecting a central aperture with the side edge of the stabilizer. After the head of the screw has been placed into the crossed slots, the stabilizer is friction fit within the sleeve with the screw's threads being held against wobble by the central aperture. When the sleeve is turned by the extendable pole, the screw will be screwed into an elevated structure. By pulling on the pole, the rubber stabilizer will then release the screw through its slit and the sleeve's slot. The driver of Allen et al is complex and difficult to use, because of its many parts and its mode of use, and would not be cost effective for driving the hundreds of fasteners necessary to suspend a drop ceiling into a building structure.

OBJECTS AND SUMMARY OF THE INVENTION

The present invention overcomes the difficulties described above by providing a driver for pre-wired threaded fasteners which is simple in construction, reliable in use, and fast in operation.

It is an object of the invention, therefore, to provide a driver head for securing pre-wired threaded fasteners to the ceiling of a building structure, the driver head being a rigid, integral shaft with intersecting grooves formed therein, one of the grooves designed to hold the threaded fastener and the other of the grooves designed to constrain a side-wrap of the wire.

It is a further object of the invention to provide a driver including a driver head having no moving parts for holding a pre-wired threaded fastener in combination with a power-driven, telescoping pole which has provisions for confining the free end of the wire from uncontrolled spinning due to the centrifugal force created by threading the fastener into a ceiling.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENTS

Figure 1:
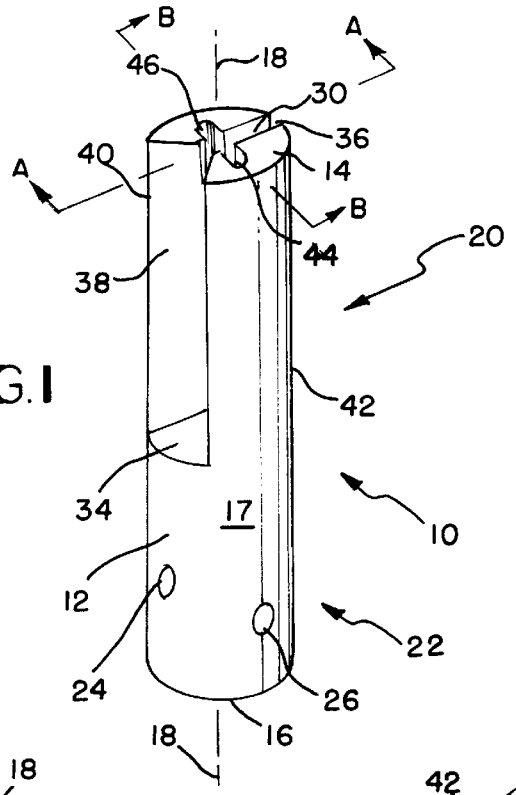
FIG. 1 is a perspective view which illustrates a preferred embodiment of the threaded fastener driver head of the present invention.
Figure 4:
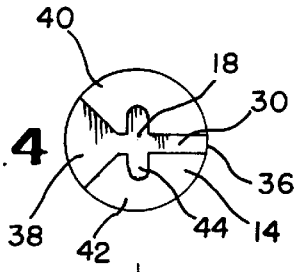
FIG. 4 is a top view of the threaded fastener driver head in the orientation shown in FIG. 2.
Figure 5:
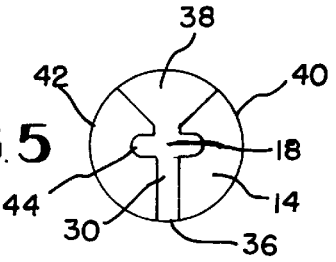
FIG. 5 is a top view of the threaded fastener driver head in the orientation shown in FIG. 3.

Referring to FIGS. 1–5, a threaded fastener driver head 10 comprises a shaft 12 having a top end 14, a bottom end 16, a cylindrical sidewall 17 connecting said top end 14 and said bottom end 16, a longitudinal axis 18, an upper working end 20, and a lower support end 22. The material of shaft 12 must be strong enough to withstand the stresses of driving threaded fasteners securely into the permanent ceilings of building structures without breaking or suffering undue bending. Various grades of cold rolled steel, e.g., #12 L14 and others (not heat treated), stress proof #1144 (when heat treated up to 50 Rockwell hardness), and alloy steel #4130, have been found to be suitable. The list is not all-inclusive, and the invention is not limited thereby.

Support end 22 includes two bores 24 and 26, extending diametrically through cylindrical shaft 12. Bores 24 and 26 are axially offset and orthogonal relative to each another, as most clearly seen in FIGS. 2–3. Bores 24 and 26 are adapted to mount driver head 10 onto a telescoping pole 28, as will be described later relative to FIGS. 8–9.

Upper working end 20 includes a kerf 30 which in the first embodiment extends transversely across the entire diameter of cylinder 12 and passes through axis 18. Kerf 30 is open through top end 14 at its upper end 32 and closed at its lower end 34. Kerf 30 is relatively narrow for most of its length and opens axially as slot 36 through sidewall 17 of shaft 12. Kerf 30 expands into a pie-shaped, tapered recess 38, preferably having an included angle of substantially 90°, as shown in FIGS. 1–5 and 8, which opens axially through sidewall 17 of shaft 12 diametrically opposite narrow slot 36. Kerf 30 extends axially downwardly from top end 14 a sufficient distance to be able to effect its function, to be explained later. Kerf 30 effectively divides working end 20 into two columns 40 and 42. This is an improvement over such prior art drivers as those disclosed in U.S. Pat. No. 5,012,624, to Dahlgren, supra, U.S. Pat. No. 5,507,209, to Allen et al, supra, and U.S. Pat. No. 5,439,338, to Rosenberg, supra. Those drivers have cross-kerfs open at all diametrical ends, forming four separate columns, which are inherently weaker than the two larger columns of the instant invention.

An elongated blind recess 44, centered on axis 18, intersects kerf 30 axially at substantially a right angle. Recess 44 is closed at its bottom 45 and open at its top 46, as most clearly seen in FIGS. 4 and 5. Recess 44 is shown as being axially shorter than kerf 30, but the relative lengths are not critical.

Figure 6:
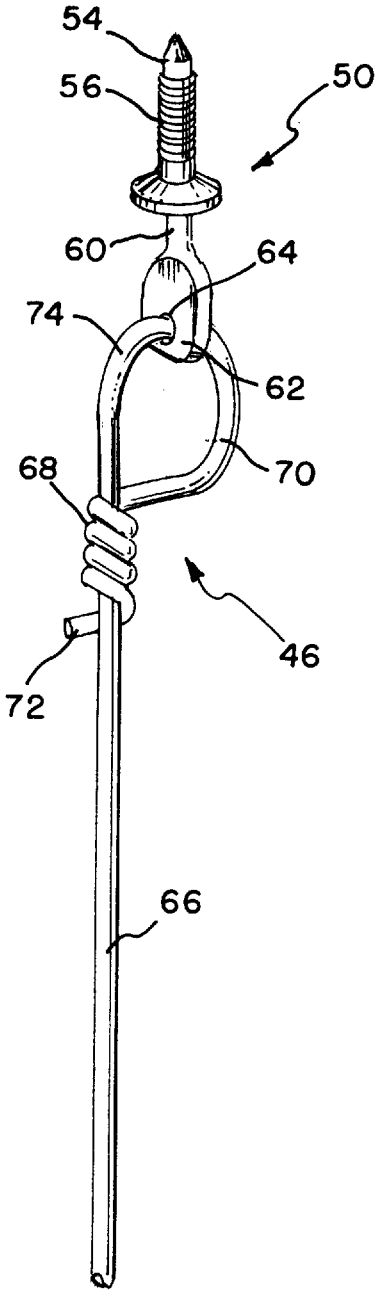
FIGS. 6–7 are perspective views of the pre-wired threaded fastener assemblages used with the threaded fastener driver head of FIGS. 1–5.
Figure 7:
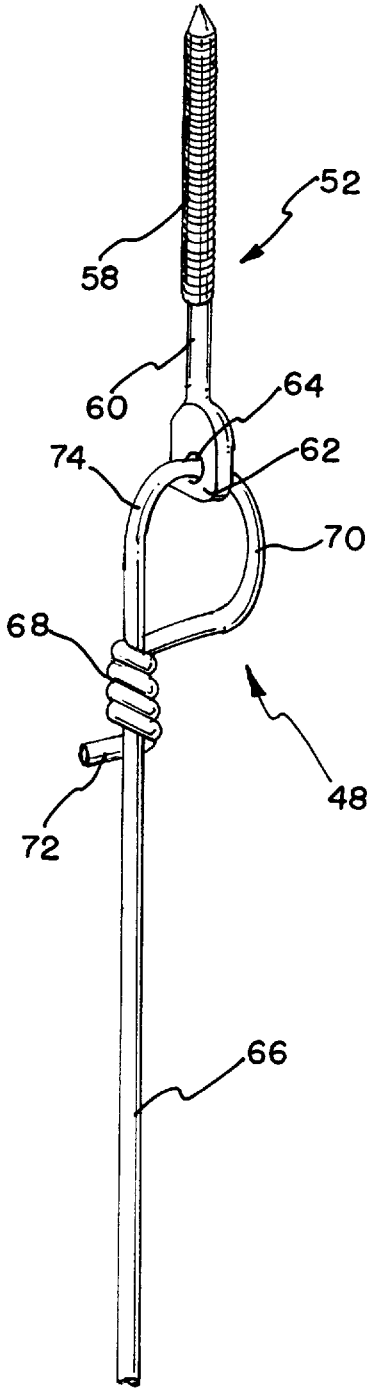

An important concept of the disclosed invention is the use with driver head 10 of pre-wired threaded fastener assemblages 46 and 48 of the type shown in FIGS. 6 and 7, respectively. Threaded fasteners 50 and 52 are representative, but not inclusive, of all the fasteners intended to be used with driver head 10. For example, eye bolts and/or threaded fasteners designed to be threaded into concrete are also driven easily by driver head 10. Fasteners 50 and 52 are well known in the field and are commonly used as anchors for suspending the frames of dropped, secondary, or acoustical ceilings from the permanent wood or metal ceilings of building structures. They are also used to support air conditioning ducts, electrical conduits, water pipes, etc.

Fastener 50 is a so-called metal fastener, because it has a cutting tip 54 for drilling its own hole in metal or other hard materials. Specially shaped screw threads 56 cut into the material and hold fastener 50 securely in place. Fastener 52 is intended for softer materials, such as wood, and is usually referred to as a wood screw or a lag screw. Its screw threads 58 extend to its tip and are shaped to hold in wood. Both fasteners include an unthreaded bolt stem 60 of appropriate length ending in a generally planar profile, such as flat head 62. An aperture 64 through head 62 receives therethrough a hanger wire, cable, or chain 66 for attachment to the aforementioned suspended ceiling framework. The term "wire" as used hereinafter, and in the claims, is a generic term for these and all similar entities, and is not restrictive to a wire perse. For convenience in describing the invention, the remainder of the specification will be written in terms of a lag screw type threaded fastener 52 with a wire 66 pre-wired thereto. Such a description is not intended to exclude any other application of the invention which is within the scope of the claims.

Wire 66 is attached to threaded fastener 52 prior to the latter being threaded into a building structure until it is fully secured. This is an improvement over traditional methods which first attach threaded fasteners to building structures and subsequently bend the wires thereto, e.g., as disclosed in U.S. Pat. No. 5,012,624, to Dahigren, supra, or as described in the instructions for using the "LagMaster." This is obviously a time consuming task requiring considerable skill, strength, and stamina. With the instant invention, threaded fastener 52 is pre-wired using a hand tool or an automatic machine before the assemblage 48 of threaded fastener 52 and wire 66 is taken to the job site. An enormous amount of the time of workers who install suspended ceilings is saved by pre-wiring the fastener.

Another important concept of the invention is the fact that wire 66 is side-wrapped, as illustrated in FIGS. 6 and 7. The major extent of wire 66 as shown in FIGS. 6 and 7 is linear, i.e., straight with no kinks or bends. Wrap 68 is twisted around a linear portion of wire 66 placing closed loop 70 off-set from the major lineal direction of wire 66. That is, the free end 72 of wire 66 is initially bent to form arcuate portion 74 of closed loop 70 and subsequently twisted about a straight portion of wire 66 below the initial bend to form wrap 68. When viewed from the side, therefore, the combination of wire and loop looks like a "P" with wrap 68 off to the side of the closed loop, i.e., side-wrapped. When attached to threaded fastener 52, side-wrapping of wire 66 orients the major linear extent of wire 66 parallel to but spaced from the axis of its associated threaded fastener, as clearly shown in FIGS. 6 and 7. Of course, when supporting a dropped ceiling framework, the weight of the dropped ceiling pulls on loop 70, distorting loop 70, until the major linear extent of wire 66 is coaxial with the axis of threaded fastener 52. Side-wrapping wire 66 facilitates the driving of threaded fasteners 52 into the building structure, but it is irrelevant to supporting a suspended ceiling.

Figure 8:
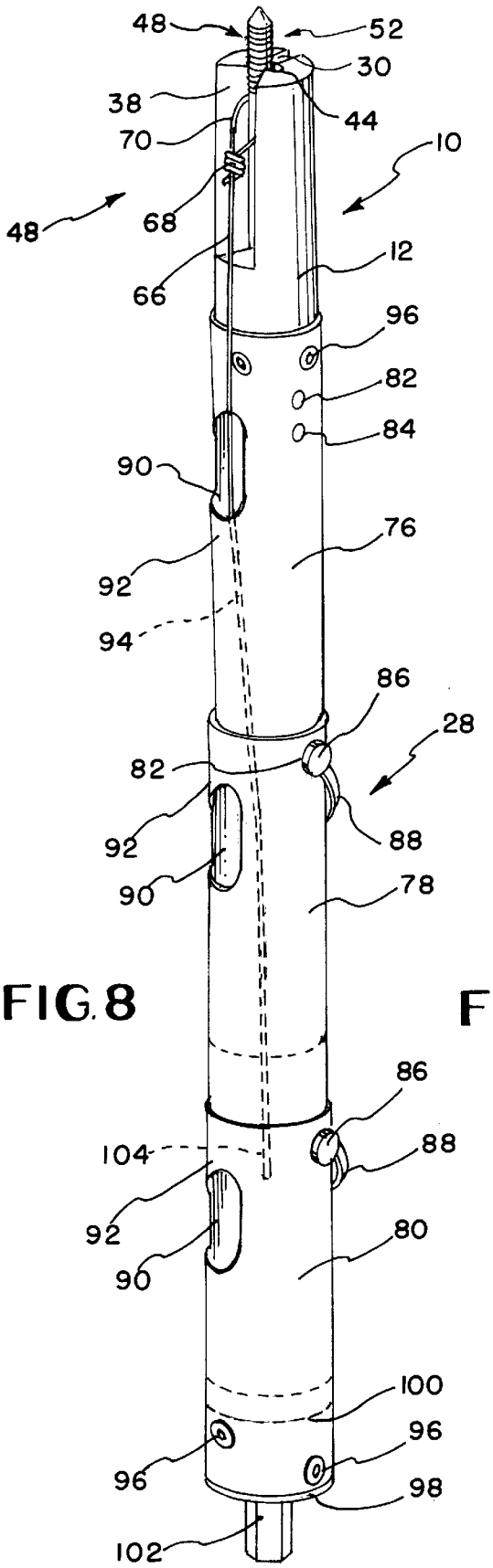
FIG. 8 is a perspective view of the threaded fastener driver head of FIGS. 1–5 attached to a telescoping pole with the pre-wired threaded fastener assemblage of FIG. 7 fit therein.

FIG. 8 shows driver head 10 attached to a telescoping pole 28. Telecoping pole 28 is shown as comprising three sections, an upper section 76, a middle section 78, and a lower section 80. The length of the individual sections and the length range of the pole needed to reach the building ceiling will depend on the height of the ceiling; an eight foot ceiling does not require as long a pole as a thirty foot ceiling. A plurality of poles of different length ranges could easily be made available. The disclosed poles are exemplary of the principles involved and are not restrictive of the invention's scope. Telescoping poles per se are known in the art and need not be described in detail, except as pertains to the instant invention.

Telescoping pole 28 is typically three sections as shown with each section being approximately three feet in length. Upper section 76 and middle section 78 have a first pair of diametrically aligned holes 82 (only one shown) located near the top of the section and a second pair of holes 84, parallel to the first pair, spaced axially downwardly about two inches from the first pair. Two more parallel pairs (hidden within sections 78 and 80) are spaced axially one foot apart down each section. Lower section 80, being the outermost section, has only one pair of holes 82 near the top of the section. When telescoping pole 28 is collapsed to its shortest length (not shown), the top pair of holes 82 of sections 76 and 78 will be aligned, and the second pair of holes 84 in sections 76 and 78 will be aligned with the sole pair of holes 82 in section 80. A latch pin 86 is inserted through aligned pairs of holes in two sections to secure telescoping pole 28 at the selected length. A spring clip 88 is fixed to one end of latch pin 86 and extends around the circumference of the pole section, where it is snap-fit over the other end of latch pin 86, thereby retaining the latch pin in the aligned holes. As shown in FIG. 8, one latch pin 86 extends through holes 82 of section 78 and the pair of holes (not shown) in section 76 which are one foot below holes 84; section 76 has about fifteen inches exposed, therefore. Another latch pin 86 extends through holes 82 in section 80 and through the pair of holes (not shown) in section 78, which are one foot below its holes 84, also exposing about fifteen inches of section 78. The entire three feet of section 80 (compressed to fit the drawings) is exposed. As shown in FIG. 8, therefore, pole 28 is fixed at about six feet long, quite adequate for most ceilings.

Telescoping pole 28 is preferably made from hollow, aluminum tubing with the upper sections being progressively smaller in diameter than the lower sections. An aperture 90 is provided through the side wall 92 of each section of telescoping pole 28. All of the apertures 90 are located such that when pole 28 is closed to its shortest length, they will align with each other, thereby providing access to the hollow interior 94 of pole 28. Before beginning work, a plurality of pre-wired assemblages 48 are stored in hollow interior 94 by inserting wires 66 through the aligned apertures 92 into interior 94. On the job site, the stored assemblages 48 are removed, telescoping pole 28 is set at the desired length, and the stored assemblages 48 are replaced in aperture 90 of upper section 76, the telescopic sliding of an upper section relative to a lower neighbor having covered the lower sections' aperture. When it is desired to use them, they are removed one at a time and individually fit into head 10.

Figure 2:
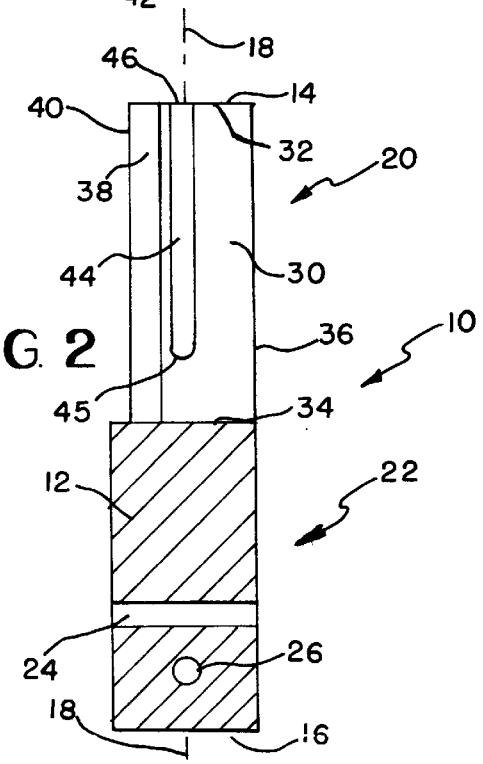
FIG. 2 is a side view of the threaded fastener driver head as seen in cross-section along the plane indicated by lines A—A of FIG. 1.
Figure 3:
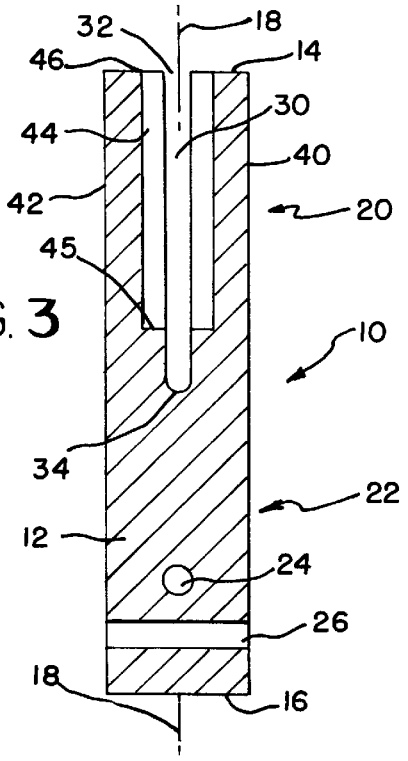
FIG. 3 is a side view of the threaded fastener driver head as seen in cross-section along the plane indicated by lines B—B of FIG. 1.

As shown in FIG. 8, driver head 10 is attached to upper section 76 by four metal screws 96 (only two of which are diagramatically shown in the drawings) which are threaded into the internal ends of bores 24 and 26, shown exaggerated in size in FIGS. 1–3 to facilitate an understanding of their mutual relationships. Head 10 thus closes the upper end of telescoping pole 28. The bottom of telescoping pole 28 is closed by a short, solid plug 98 inserted into the open base of lower section 78, the upper perimeter of plug 98 being indicated by dashed lines 100. A hexagonally shaped shaft 102 extends integrally from plug 98. Shaft 102 has flats designed to be tightly gripped by a conventional chuck of a drill, screwgun, or other suitable powered driving means (not shown). It is envisioned that plug 98 be secured to pole 28 in the same manner as driver head 10, i.e., by means of metal screws 96 coacting with axially offset, diametrical bores similar to bores 24 and 26.

A pre-wired threaded fastener 48 is shown held by driver head 10 within recess 44. Pre-wired threaded fastener 48 is fit into driver head 10, where flat head 62 is frictionally held by recess 44. The four corners of the intersection of recess 44 and kerf 30 (see FIGS. 4 and 5) are spaced relative to each other to support bolt stem 60 against wobble with the axis of threaded fastener 52 being held substantially coaxially with axis 18 of driver head 10. This facilitates the threading of threaded fastener 52 securely into the building structure.

It is of practical importance that wire 66 not flop around uncontrollably, when threaded fastener 52 is being threaded into the building ceiling. Kerf 30 contributes greatly to this desired result. The narrow portion of kerf 30 maintains loop 70 of wire 66 perpendicular to flat head 62, which places side-wrap 68 in tapered recess 38, which in turn allows the major linear extent of wire 66 to hang freely alongside pole 28. Tapered recess 38 allows wrap 68 to be as close to axis 18 of shaft 12 as possible, thus, allowing wire 66 to be closely adjacent to sidewall 17 without being bent. Tapered recess 38 also adds to the stability of the upper portion of wire 66 by loosely constraining wrap 68 from lateral movements. Although recess 38 is disclosed as being 90°, and that is the desideratum, so long as the included angle is sufficient for recess 38 to receive and loosely guard wrap 68 against untoward lateral movements, its specific value is not critical. It has been found, however, that a value of at least 45° is desirable.

It is not enough, however, that loop 70 and wrap 66 be constrained by kerf 30 alone against major movements. If the remainder of wire 66 were left free, it would spin around head 10 like a weed-whacker string, when pole 28 is being rapidly rotated by a screwgun, which could be very dangerous. In order to prevent this, it is necessary to limit the movements of the free end 104 of string 66. The free end 104 and as much of the length of wire 66 as is necessary is inserted through aperture 90 into hollow interior 94 of pole 28. The portion of wire 66 immediately below loop 70 must pass externally of driver head 10, but the remaining portion, including free end 104, will be confined within hollow interior 94.

Figure 9:
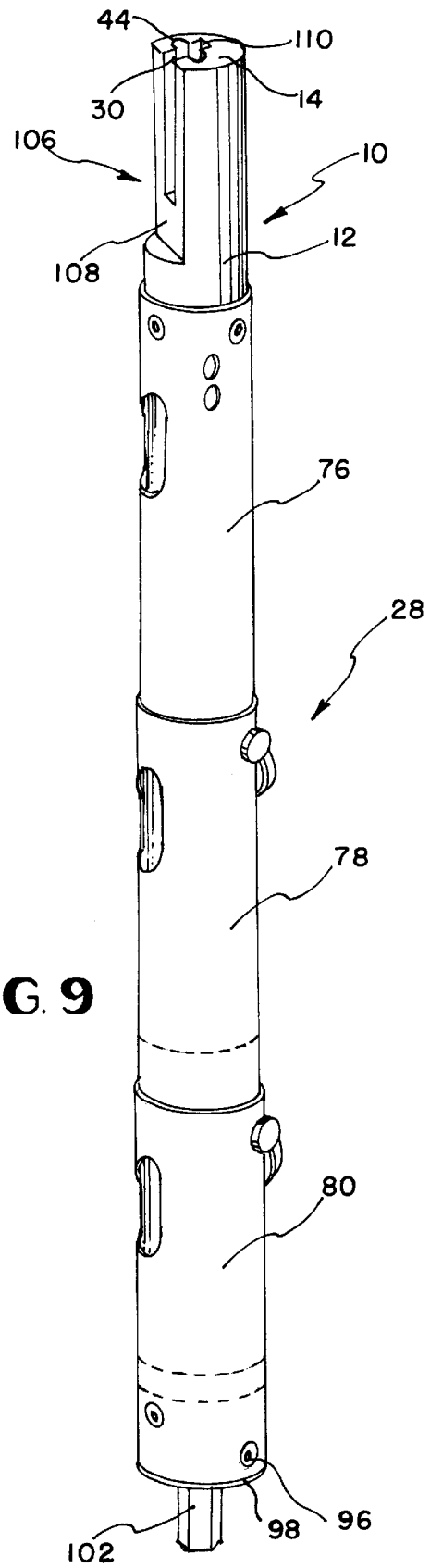
FIG. 9 is a perspective view of another threaded fastener driver head attached to a telescoping pole.

Two modifications of head 10 are shown in FIG. 9, where similar structural elements are indicated by the same reference numerals.

In FIG. 9, chordal recess 106, corresponding to tapered recess 38 is shown, as having been formed by removing a chordal segment of cylinder 12. In this embodiment, kerf 30 opens through a flat surface 108 which is substantially orthogonal to kerf 30. While a head having a chordal recess is simpler to manufacture, the burden of supporting wrap 68, and thereby the upper end of wire 66, falls exclusively on the attachment of loop 70 to flat head 62 of threaded fastener 52. It is possible this could put a strain on wire 66 under extreme circumstances. The embodiment of FIG. 9 works well under normal conditions, but the embodiment of FIGS. 1–5 and 8 is preferred.

The other modification is seen in FIG. 9 by looking at the top end 14 of driver head 10. Kerf 30 does not extend all the way through the back of cylinder 12. Instead, the back end 110 of kerf 30 is closed. The number of columns is thereby reduced to one, increasing the strength of the working end. In effect, working end 20 is nothing more than cylinder 12 with a plus-shaped slot therein opening into chordal recess 106. This embodiment is particularly effective, when an increased torque is imposed on head 10 by the work environment and/or the type of threaded fastener used. Clearly, closing kerf 30 can advantageously be used with a tapered recess 38 of less than 180° as well, just as the chordal recess 106 can be used with the through kerf 30 of FIGS. 1–5 and 8.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

I claim as my invention:

1. A driver head for a pre-wired threaded fastener, comprising:

a shaft, said shaft including a top end, a bottom end, a sidewall connecting said top and bottom ends, and an axis passing through both said top and bottom ends;

a kerf extending transversely and axially of said shaft and passing through said axis, said kerf (1) opening through said top end, (2) having an axially extending portion with a relatively narrow width throughout most of its diametrically extending dimension, and (3) having an axially extending portion with a tapered recess opening through one portion of said sidewall, said axially extending tapered recess defining an included angle; and an elongated blind recess extending transversely and axially of said shaft, said blind recess passing through said axis and opening only through said top end, said blind recess intersecting said kerf.

2. A driver head as in claim 1, wherein said shaft is cylindrical and said blind recess intersects said kerf substantially orthogonally.

3. A driver head as in claim 1, wherein the included angle of said tapered recess when viewed in cross-section is at least 45 degrees.

4. A driver head as in claim 2, wherein the included angle of said tapered recess when viewed in cross-section is substantially 90 degrees.

5. A driver head as in claim 1, wherein the axially extending narrow width portion of said kerf opposite said tapered recess is closed.

6. A driver head as in claim 1, wherein the axially extending narrow width portion of said kerf opposite said tapered recess is open through said sidewall.

7. A driver head as in claim 1, wherein means for attaching said driver head to a driver is located adjacent said bottom end of said shaft.

8. A driver head as in claim 7, wherein said attaching means comprises a pair of orthogonal, diametrical bores adapted to receive threaded screws.

9. The combination of a driver head and a pre-wired threaded fastener assemblage, comprising:

(1) said driver head comprising:

(a) a shaft, said shaft including a top end, a bottom end, a sidewall connecting said top and bottom ends, and an axis passing through both said top and bottom ends;

(b) a kerf extending transversely and axially of said shaft and including said axis, said kerf (i) opening through said top end, (ii) having an axially extending portion with a relatively narrow width throughout most of its diametrically extending dimension, and (iii) having an axially extending portion with a tapered recess opening through one portion of said sidewall, said axially extending tapered recess defining an included angle; and (c) a blind recess extending transversely and axially of said shaft, said blind recess including said axis and opening only through said top end, and said blind recess intersecting said kerf;

(2) said pre-wired threaded fastener assemblage being fit into said driver head, said assemblage comprising:

(a) a threaded fastener having screw threads at one end and a generally planar profile at the other end, said planar profile being fit into said blind recess; and (b) a wire attached to said planar profile, said wire including a wrap which is side-wrapped to form a loop offset from the major lineal direction of said wire, said wrap being fit into said tapered recess; and (3) means connected to said driver head for rotating said driver head.

10. The combination of claim 9, wherein said blind recess intersects said kerf substantially orthogonally.

11. The combination as in claim 10, wherein the included angle of said tapered recess when viewed in cross-section is at least 45 degrees.

12. The combination as in claim 10, wherein the included angle of said tapered recess when viewed in cross-section is substantially 90 degrees.

13. The combination of claim 10, wherein the axially extending narrow width portion of said kerf opposite said tapered recess is closed.

14. The combination of claim 10, wherein the axially extending narrow width portion of said kerf opposite said tapered recess is open through said sidewall.

15. The combination of claim 10, wherein means for attaching said driver head to a driver is located adjacent said bottom end of said shaft.

16. The combination of claim 15, wherein said attaching means comprises a pair of orthogonal, diametrical bores adapted to receive threaded screws.

17. The combination of claim 10, wherein said means for rotating said driver head comprises a hollow telescoping pole having at least one aperture through its sidewall.

18. The combination of claim 17, wherein said telescoping pole has means at its base for drivingly connecting said driver to a powered driving means.

19. A driver head for a threaded fastener, comprising:

a cylindrical shaft, said shaft including a top end, a bottom end, a sidewall connecting said top and bottom ends, and an axis passing through both said top and bottom ends;

a kerf extending transversely and axially of said shaft and passing through said axis, said kerf opening through said top end and having a relatively narrow width;

a chordal surface extending axially from said top end and intersecting said kerf substantially orthogonally, said surface being the result of the removal of an axially extending chordal segment from said cylindrical shaft; and an elongated blind recess extending transversely and axially of said shaft, said blind recess opening only through said top end, passing through said axis, and intersecting said kerf.

* * * * *